US008858250B2

(12) United States Patent
Brodsky et al.

(10) Patent No.: US 8,858,250 B2
(45) Date of Patent: Oct. 14, 2014

(54) ELECTRICAL CABLE ASSEMBLY

(71) Applicant: International Business Machines Corporation, Armonk, NY (US)

(72) Inventors: William Louis Brodsky, Binghamton, NY (US); Mark Garrison Clark, Rochester, MN (US); Eric James McKeever, Poughkeepsie, NY (US); John G. Torok, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 100 days.

(21) Appl. No.: 13/622,463

(22) Filed: Sep. 19, 2012

(65) Prior Publication Data

US 2014/0080341 A1 Mar. 20, 2014

(51) Int. Cl.
*H01R 13/62* (2006.01)

(52) U.S. Cl.
USPC ..... 439/310

(58) Field of Classification Search
CPC ..... H01R 13/6275; H01R 43/26; H01R 13/62955; H01R 13/629; H01R 13/625; H01R 13/514
USPC ..... 439/310, 311, 314, 318, 372, 374, 378
See application file for complete search history.

(56) References Cited

U.S. PATENT DOCUMENTS

| | | | | |
|---|---|---|---|---|
| 2,939,905 | A | 6/1960 | Canfield | |
| 3,447,036 | A | 5/1969 | Dore et al. | |
| 3,478,302 | A * | 11/1969 | Chirumbolo | 439/314 |
| 3,594,689 | A * | 7/1971 | Hopt et al. | 439/292 |
| 3,950,059 | A * | 4/1976 | Anhalt et al. | 439/261 |
| 4,281,211 | A | 7/1981 | Tatum et al. | |
| 4,424,691 | A * | 1/1984 | Foshee | 70/224 |
| 4,731,500 | A | 3/1988 | Otsuka | |
| 4,889,500 | A | 12/1989 | Lazar et al. | |
| 5,007,858 | A | 4/1991 | Daly et al. | |
| 5,266,047 | A | 11/1993 | Black et al. | |
| 5,434,354 | A | 7/1995 | Baker et al. | |
| 5,437,564 | A | 8/1995 | Lignelet | |
| 5,532,429 | A | 7/1996 | Dickerson et al. | |
| 5,554,045 | A * | 9/1996 | Bethurum | 439/372 |
| 5,596,175 | A | 1/1997 | Ysbrand | |
| 6,217,368 | B1 | 4/2001 | Baron et al. | |
| 6,273,742 | B1 | 8/2001 | Castagna et al. | |
| 6,333,465 | B1 | 12/2001 | Prudhon | |

(Continued)

FOREIGN PATENT DOCUMENTS

| | | |
|---|---|---|
| EP | 0599672 A1 | 6/1994 |

*Primary Examiner* — Xuong Chung Trans
(74) *Attorney, Agent, or Firm* — L. Jeffrey Kelly; Margaret Pepper

(57) ABSTRACT

A cable assembly structure, the structure including a connector having a connector body having a back end and a front end, a cam extending from and coupled to the back end of the connector body, a wire bundle extending from and coupled to the back end of the connector body; and a pair of guidance features extending from the front end of the connector body; and a receptacle having a receptacle body having a fixed end and an open end, and a pair of cam guides positioned on a top and a bottom surface of the receptacle. The cam is operable to couple the connector with the receptacle based on the guidance features aligning the connector with the receptacle, the cam guides being operable to receive the cam associated with the connector.

20 Claims, 4 Drawing Sheets

(56) References Cited

U.S. PATENT DOCUMENTS

| | | | | |
|---|---|---|---|---|
| 6,595,796 | B1 | 7/2003 | Koegel et al. | |
| 6,639,808 | B1 | 10/2003 | Umberger | |
| 6,945,712 | B1 | 9/2005 | Conn | |
| 7,099,591 | B2 | 8/2006 | Goel | |
| 7,200,295 | B2 | 4/2007 | Rolston et al. | |
| 7,326,090 | B2 * | 2/2008 | Cayzac | 439/680 |
| 7,416,353 | B2 | 8/2008 | Yoshikawa et al. | |
| 7,465,197 | B1 | 12/2008 | Wu et al. | |
| 7,524,213 | B2 | 4/2009 | Neer et al. | |
| 7,583,871 | B1 | 9/2009 | Behir et al. | |
| 7,637,768 | B1 | 12/2009 | Hsu | |
| 7,824,112 | B2 | 11/2010 | Epitaux et al. | |
| 7,824,113 | B2 | 11/2010 | Wong et al. | |
| 7,833,064 | B1 | 11/2010 | Lai | |
| 7,881,578 | B2 | 2/2011 | Jacobsen et al. | |
| 7,959,363 | B2 | 6/2011 | Scheibenreif et al. | |
| 8,152,537 | B1 | 4/2012 | Montena | |
| 2003/0102148 | A1 | 6/2003 | Ohara et al. | |
| 2003/0106705 | A1 | 6/2003 | Daane et al. | |
| 2006/0180339 | A1 | 8/2006 | Huffman | |
| 2007/0187133 | A1 | 8/2007 | Amato et al. | |
| 2008/0185168 | A1 | 8/2008 | Matsukawa et al. | |

* cited by examiner

ELECTRICAL CABLE ASSEMBLY

BACKGROUND

1. Field of the Invention

The present invention generally relates to providing a secure mechanical connection between cable connectors and mating connectors or terminals, and, more particularly, to providing a means for connecting cable connectors requiring high mating forces.

2. Background of Invention

Computer systems have many component parts designed to operate cooperatively and require various types of connections between the component parts. For example, server systems may often have several electronic circuit boards that may be connected with cables that allow communication between them.

The scalability of certain types of computer systems, including, for example, blade servers, facilitates the addition of new components or the reconfiguration of existing components in a data center. Generally, components within a particular system may be tightly configured to provide a high component density. Such high component density may provide less area to facilitate the physical connection of the various components using cable assemblies. Furthermore, some connections between system components may require anywhere from 10 lbs to 40 lbs of linear force to insert or remove the connector from its mating receptacle.

Therefore, it may be advantageous, among other things, for an electrical cable assembly to facilitate a cable connection with high mating forces, for example, in a confined space.

SUMMARY

According to one embodiment of the present invention, a cable assembly structure is provided. The cable assembly structure may include a connector and a receptacle. The connector including a connector body having a back end and a front end, a cam extending from and coupled to the back end of the connector body, a wire bundle extending from and coupled to the back end of the connector body, and a pair of guidance features extending from the front end of the connector body. The receptacle including a receptacle body having a fixed end and an open end, and a pair of cam guides positioned on a top and a bottom surface of the receptacle. The cam is operable to couple the connector with the receptacle based on the guidance features aligning the connector with the receptacle, the cam guides being operable to receive the cam associated with the connector.

According another exemplary embodiment, a connector structure including a connector body, the connector body having a back end and a front end is provided. The connector structure may include a cam extending from and coupled to the back end of the connector body, wherein the cam rotates freely relative to the connector body; a wire bundle extending from the back end of the connector body; and a pair of guidance features extending from the front end of the connector body, wherein the pair of guidance features are operable to align the connector structure with a receptacle, and wherein the cam is operable to couple the connector with the receptacle upon rotating the cam.

According another exemplary embodiment, a receptacle structure including a receptacle body having a fixed end and an open end is provided. The receptacle structure may include a pair of cam guides positioned on a top and a bottom surface of the receptacle, wherein the cam guides are operable to receive a corresponding cam associated with a connector.

According another exemplary embodiment, a method of mating a connector with a receptacle is provided. The method may include inserting the connector into an open end of the receptacle, and rotating a cam coupled to a back end of the connector, the cam engages with a cam guide associated with the receptacle, causing the cam to impose a linear force on the connector, the linear force being substantially parallel with the axis of rotation of the cam and substantially perpendicular to the back end of the connector, and causing the connector to fully mate with the receptacle.

BRIEF DESCRIPTION OF THE SEVERAL VIEWS OF THE DRAWINGS

The following detailed description, given by way of example and not intend to limit the invention solely thereto, will best be appreciated in conjunction with the accompanying drawings, in which.

The drawings are not necessarily to scale. The drawings are merely schematic representations, not intended to portray specific parameters of the invention. The drawings are intended to depict only typical embodiments of the invention. In the drawings, like numbering represents like elements.

DETAILED DESCRIPTION

Detailed embodiments of the claimed structures and methods are disclosed herein; however, it can be understood that the disclosed embodiments are merely illustrative of the claimed structures and methods that may be embodied in various forms. This invention may, however, be embodied in many different forms and should not be construed as limited to the exemplary embodiments set forth herein. Rather, these exemplary embodiments are provided so that this disclosure will be thorough and complete and will fully convey the scope of this invention to those skilled in the art. In the description, details of well-known features and techniques may be omitted to avoid unnecessarily obscuring the presented embodiments.

Referring now to FIGS. 1-10 an electrical cable assembly in accordance with one embodiment of the present invention is shown. Specifically, a connector having a cam may be inserted into a receptacle having a cam guide. Upon inserting the connector into the receptacle and rotating the cam clockwise, the cam may engage with the cam guide causing a linear force which further drives the connector into the receptacle. Furthermore, the connector may include guidance features to assist in the alignment of the connector with the receptacle. A compressive cable wrap may be used to join multiple individual wires into a bundle.

Figure 1:
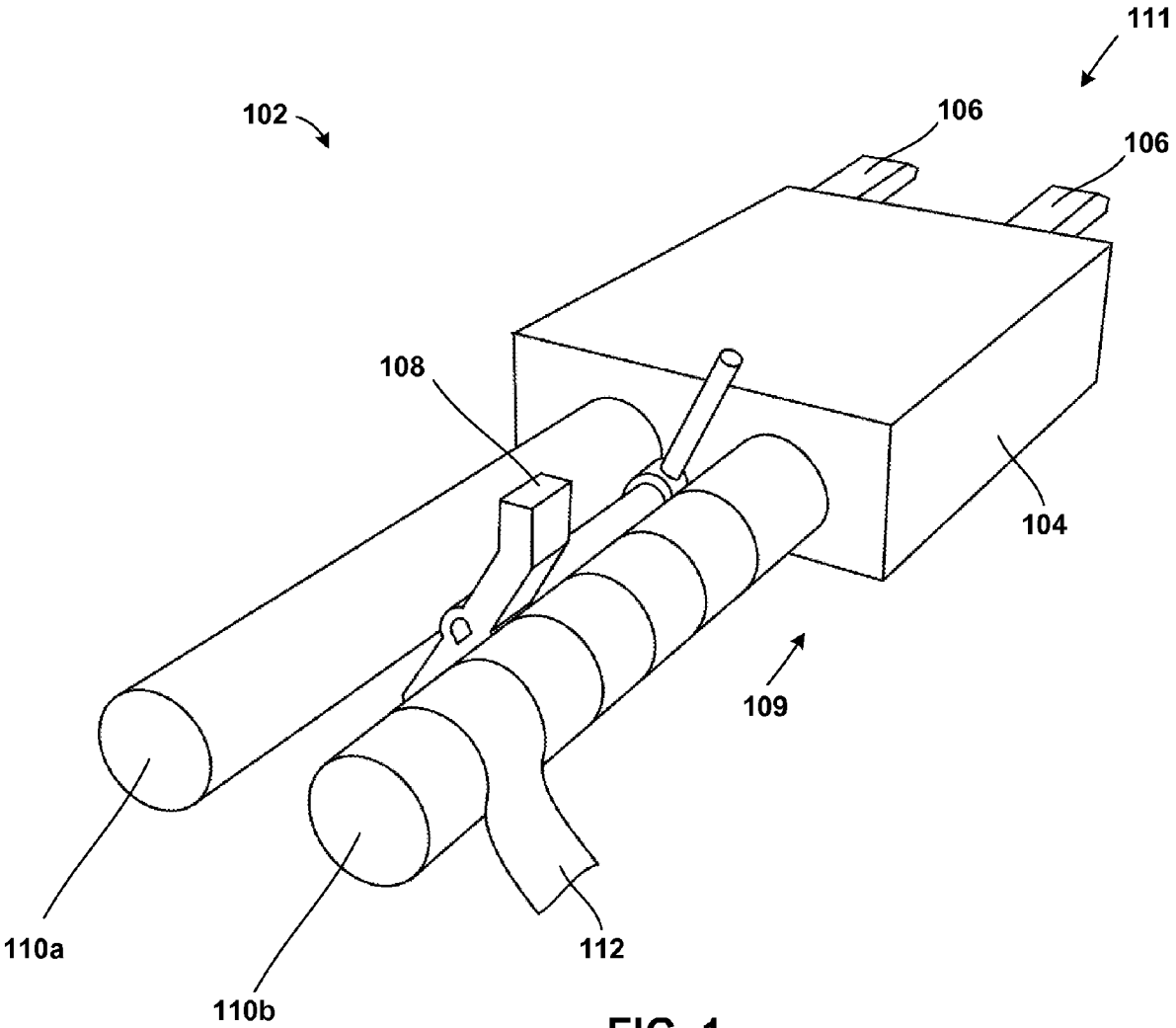
FIG. 1 depicts a perspective view of a connector according to one embodiment.

Referring now to FIG. 1, a prospective view of a connector 102 is shown in accordance with an embodiment of the present invention. The connector 102 may include a connector body 104, a pair of guidance features 106, a cam 108, and a plurality of pin contacts 114 (shown in FIG. 4). Typically, the connector may be used to make an electrical connection to a printed wiring board (PWB) card within a computer or IT system. The connector 102 may provide for termination of a pair of wire bundles 110*a*, 110*b*. In one embodiment, one wire bundle may be used for an input signal and the other wire bundle may be used for an output signal. In one embodiment, the connector 102 may terminate a single wire bundle. Generally, the pair of wire bundles 110*a*, 110*b* may protrude from a back end 109 of the connector body 104. The back end 109 may be opposite from a front end 111 of the connector body 104.

Each wire bundle 110*a* or 110*b* may include a plurality of smaller individually insulated wires arranged parallel to on another. A sheath 112 may be used as a form of cable management to join the plurality of individual wires and reduce cable bulk. The sheath 112 may reduce the effective wire bundle size and may allow the individual wires to flex and move as required during installation of the cable assembly. In one embodiment, the plurality of individual wires may include a parallel conductor wire. In one embodiment, the sheath 112 may include a compression material. The compression material may be any suitable material known in the art which is elastic and compressive like, for example, an ace bandage.

In one embodiment, the sheath 112 may be installed by wrapping it around the pair of wire bundles 110*a*, 110*b* as shown in the figures. In one embodiment, the sheath 112 may be in the form of a sleeve in which the individual wires may be fished through. In some cases the sleeve may be heat shrunk and tightly surround the pair of wire bundles 110*a*, 110*b*. Preferably, the sheath 112 may itself be made from a material with abrasion resistance properties. In one embodiment, the sheath 112 may be covered by an additional material (not shown) having abrasion resistant properties. The pair of wire bundles 110*a*, 110*b* may be any suitable size, so long as not to interfere with the action of the cam 108. An ESD or EMI shielding material (not shown) may be added either below or above the sheath 112. Any suitable material known in the art may be used as an ESD or EMI shield. For example, ESD or EMI shielding materials may include metalized Mylar or aluminum foil.

Figure 4:
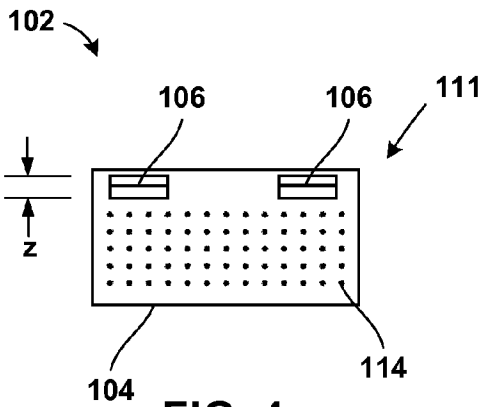
FIG. 4 depicts an orthographic projection of FIG. 1 according to one embodiment.
Figure 2:
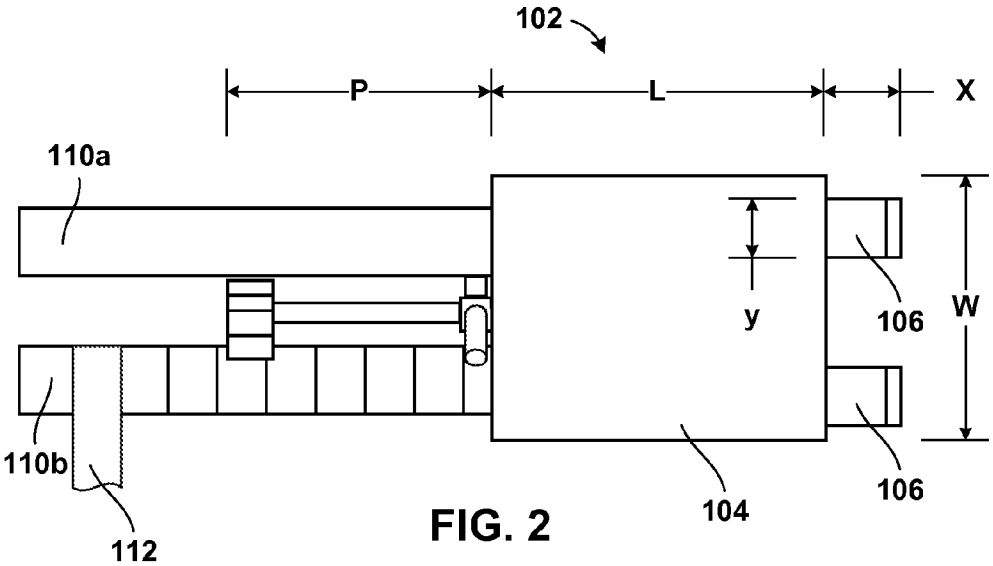
FIG. 2 depicts an orthographic projection of FIG. 1 according to one embodiment.
Figure 3:
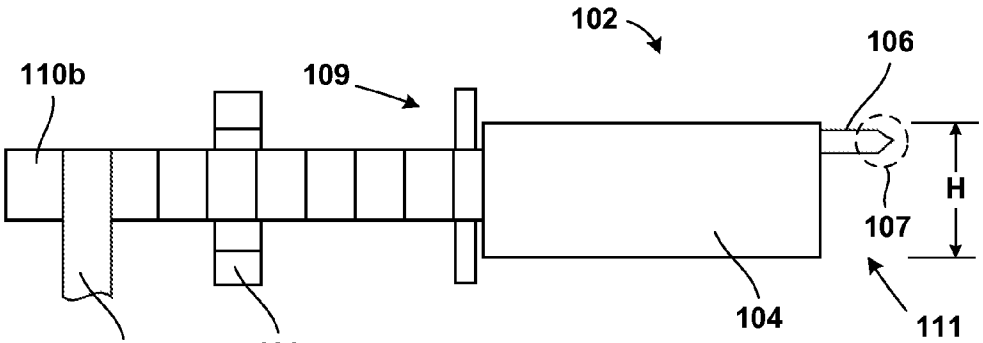
FIG. 3 depicts an orthographic projection of FIG. 1 according to one embodiment.

Now referring to FIGS. 2, 3, and 4, each of which depict an orthographic projection of FIG. 1 relative to each other in accordance with first-angle projection. The connector body 104 may have a length (L) ranging from about 2 in to about 10 in, a width (W) ranging from about 2 in to about 5 in, and a height (H) ranging from about 0.75 in to about 1.5 in. In one embodiment, the connector body 104 may preferably have a length (L) of 2.8 in, a width (W) of 2.3 in, and a height (H) of 1.1 in. The connector body 104 may be made from any suitable material known in the art. In one embodiment, the connector body 104 may be die cast from aluminum or zinc.

The pair of guidance features 106 may protrude from the front end 111 of the connector 102. The pair of guidance features 106 may be located and positioned such as to minimize the width (W) of the connector 102, and assist in 2D alignment of the connector 102 relative to a receptacle. The reduced connector width may allow for a larger number of connectors to be located, side-by-side, along on a given length of a PWB. In one embodiment, the pair of guidance features 106 may be positioned along the width of the connector 102, and near or touching a top or a bottom edge.

The guidance features 106 may have a length (x) ranging from about 0.5 in to about 1.5 in, a width (y) ranging from about 0.25 in to about 0.5 in, and a height (z) ranging from about 0.0625 in to about 0.125 in. The pair of guidance features 106 may protrude from the front end 111 of the connector 102 by a distance equal to their length (x). In one embodiment, the guidance features 106 may preferably have a length (x) of about 1 in, a width (y) of about 0.125 in, and a height (z) of about 0.0625 in. In one embodiment, the guidance features 106 may include tapered ends 107 to further facilitate locating the connector 102 during installation or removal. The pair of guidance features 106 may be made from any suitable material known in the art. In one embodiment, the guidance features 106 may be made from aluminum. A gasket material (not shown) may be applied to the front end 111 of the connector 102 to prevent contamination of connector contacts. The gasket material may include any suitable material known in the art, for example, spring fingers or fabric wrapped elastomer.

Figure 5:
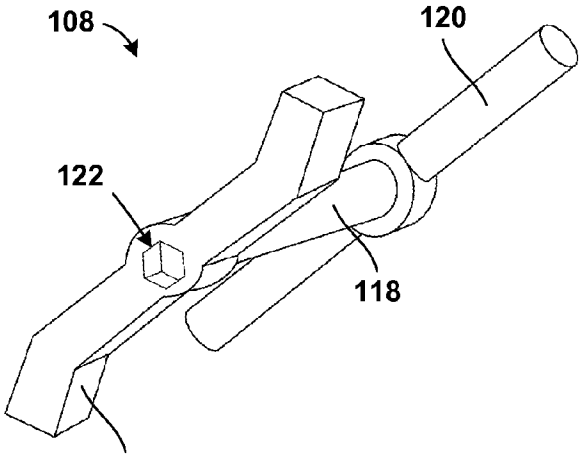
FIG. 5 depicts a perspective view of a cam according to one embodiment.

Referring now to FIG. 5, the cam 108 may include a handle 116, a shaft 118, and an actuator 120. The handle 116 may be physically coupled to the actuator 120 via the handle 118. The handle 116 and actuator 120 may be positioned substantially perpendicular to the shaft 118. The handle 116 may generally be positioned substantially parallel relative to the actuator 120, although deviation from the parallel relationship may be contemplated. The shaft 118 may generally be located at a midpoint of both the handle 116 and the actuator 120. The cam 108 may be made from any suitable material known in the art. In one embodiment, the cam 108 may be die cast from aluminum or zinc.

The handle 116 may include an ergonomic shape to allow an operator to rotate the cam 108 about the shaft 118. The actuator 120 may generally have a smooth and rounded profile to facilitate a smooth and low friction interaction with a pair of cam guides 130*a*, 130*b* (shown in FIG. 6). Furthermore, the handle 116 may include a recess 122 designed to accept a tool. The recess 122 may be designed to accept a common tool, for example an Allen wrench or a custom tool specifically designed to operate the cam 108. A cam including only a tool recess without a cam handle may be conceived.

With continued reference to FIGS. 2, 3 and 4, the cam 108 may be located in the middle of the back end 109 of the connector body 104 between the two wire bundles 110*a* and 110*b*. It may be understood that the connection between the connector body 104 and the cam 108 may include a bearing contact allowing the cam 108 to rotate freely about the shaft 118. The cam 108 may be designed to rotate about 90 degrees axially around the shaft 118; however the rotation of the cam 108 may not interfere with the pair of wire bundles 110*a*, 110*b*.

Figure 8:
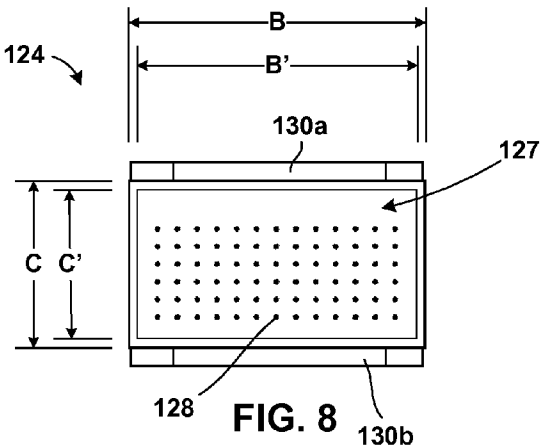
FIG. 8 depicts an orthographic projection of a receptacle according to one embodiment.
Figure 6:
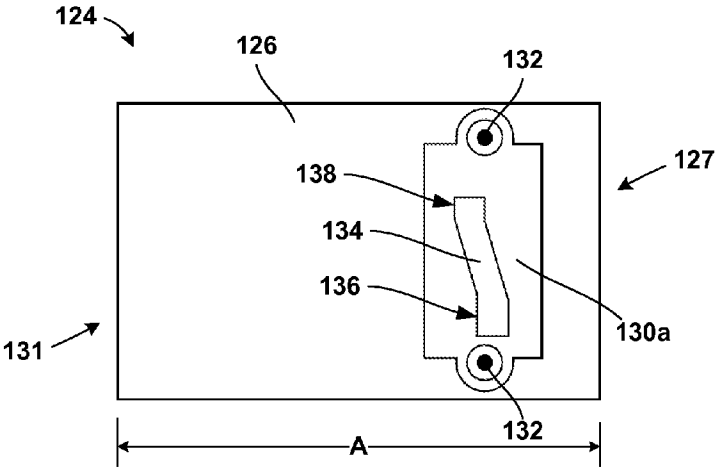
FIG. 6 depicts an orthographic projection of a receptacle according to one embodiment.
Figure 7:
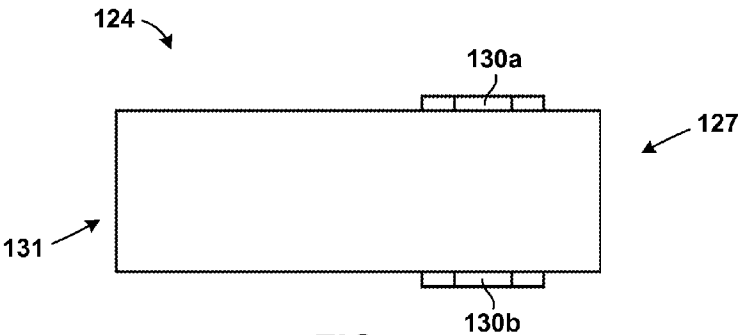
FIG. 7 depicts an orthographic projection of a receptacle according to one embodiment.

Now referring to FIGS. 6, 7 and 8, each of which depict an orthographic projection relative to each other in accordance with first-angle projection of a receptacle 124 operable to receive the connector 102 (shown in FIG. 1). In according to an embodiment of the present invention, the receptacle 124 may include a receptacle body 126, an opening 127, a plurality of socket contacts 128 located at a back end 131 of the receptacle body 126, and the pair of cam guides 130*a*, 130*b* located on opposing sides of the receptacle body 126. However, only one cam guide, 130*a*, is shown in FIG. 6. It may be understood in the art that the back end 131 of the receptacle 124, opposite the opening 127, may be permanently or semi-permanently attached to a PWB card, to which the receptacle 124 may facilitate an electrical connection to the PWB card. The plurality of socket contacts 128 may be located at, or near, a back surface of the receptacle body 126 and may receive the plurality of pin contacts 114 of the connector 102. It may be understood in the art that the receptacle 124 may include either a plurality of socket contacts (i.e. 128) or a plurality of pin contacts, (i.e. 114). For example, if a receptacle includes a plurality of socket contacts a mating connector should have a plurality of pin contacts, and vice versa.

The receptacle 124 may have a length (A), a width (B), and a height (C), measured on the outside, that may correspond with a matting connector such as the connector 104. The opening 127 may have a depth, a width (B'), and a height (C'). A mating connector such as connector 104, may be inserted into the opening 127. In the present example, the outside dimensions of the connector 104, for example W, and H, shall be less than the inside dimensions of the opening 127, for example B' and C', respectively. In one embodiment, the receptacle 124 may preferably have a length (A) of 1.2 in, a width (B) of 2 in, and a height (C) of 0.75 in. The receptacle body 126 may be made from any suitable material known in the art. In one embodiment, the receptacle body 126 may be die cast from aluminum or zinc. In one embodiment, the receptacle body 126 may be formed from sheet metal.

The pair of cam guides 130*a*, 130*b* may be located on opposite sides of the receptacle body 126, such that they may properly align with the cam 108 when mating the connector 102 with the receptacle 124. Therefore, the cam guides may generally be located near the end of the receptacle 124 having the opening 127. In one embodiment, the pair of cam guides 130*a*, 130*b* may sit flush on the outer surface of the receptacle body 126. In one embodiment, the pair of cam guides 130*a*, 130*b* may partially protrude through the receptacle body 126, but may not protrude into the opening 127 and obstruct the insertion of the connector 102 into the receptacle 124.

The pair of cam guides 130*a*, 130*b* may be made from any suitable material known in the art. In one embodiment, the pair of cam guides 130*a*, 130*b* may be made from metal, and in some cases have a low friction coating such as Teflon. In one embodiment, the pair of cam guides 130*a*, 130*b* may be formed from a plastic, for example, ultra high molecular weight polyethylene (UHMW), delirn, or nylon. The pair of cam guides 130*a*, 130*b* may be secured to the receptacle body 126 by any suitable method known in the art. In one embodiment, the pair of cam guides 130*a*, 130*b* may be secured to the receptacle body 126 using one or more suitable fasteners 132, for example screws or rivets. In one embodiment, the pair of cam guides 130*a*, 130*b* may be secured to the receptacle body 126 without fasteners by using, for example, a snapping feature or an adhesive.

The pair of cam guides 130*a*, 130*b* may have a channel 134 having a first portion 136, a second portion 137, and a third portion 138. The first portion 136 of the channel 134 may be aligned parallel to the action of the cam 108. The second portion 137 of the channel 134 located between the first portion 136 and the third portion 138 may be positioned at a first angle ranging from about 0 degrees to about 45 degrees relative to the action of the cam 108. The second portion 137 of the channel 134 may be arranged at an angle such that clockwise rotation and subsequent engagement of the cam 108 would result in the connector 102 being further inserted into the receptacle 124, and subsequent counter-clockwise rotation would result in the connector 102 being disengaged from the receptacle 124. The third portion 138 of the channel 134 may be aligned at a second angle relative to the action of the cam 108. The angle of the channel 134 at the third portion 138 may be such that it retains the position of the actuator 120, and resists counter-clockwise rotation of the cam 108. In other words, the third portion 138 of the channel 134 should capture the actuator 120 and resist its rotation such as to keep the connector 102 mated with the receptacle 124. However, an operator's force (counter-clockwise) on the cam 108 may provide a desired disengagement.

Figure 9:
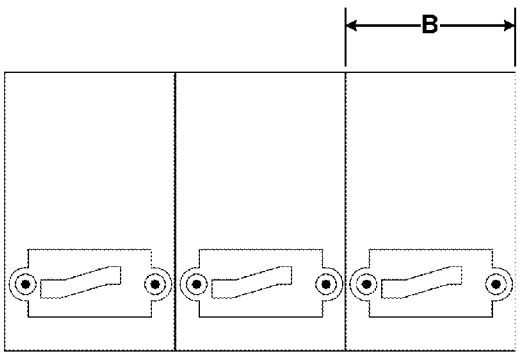
FIG. 9 depicts a plurality of receptacles configured in-line and adjacent to one another.

Now referring to FIG. 9, a plurality of receptacles may be aligned adjacent to one another, and fixed along the edge of a PWB card. Again, the width (B) of the receptacles may be such to maximize the number of receptacles along a given length of PWB card. In one embodiment the plurality of receptacles may share adjacent sides and be constructed as a single structure.

Figure 10:
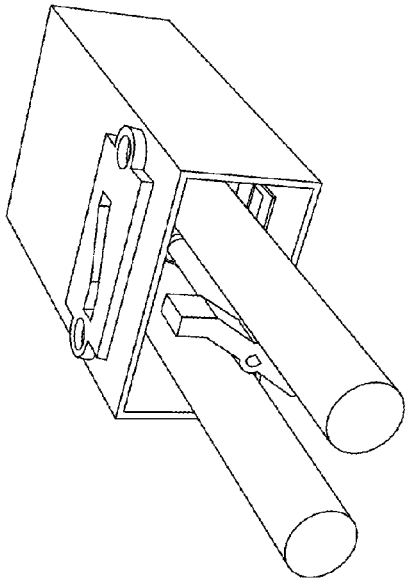
FIG. 10 depicts a perspective view of the connector mated with the receptacle according to one embodiment.
Figure 11:
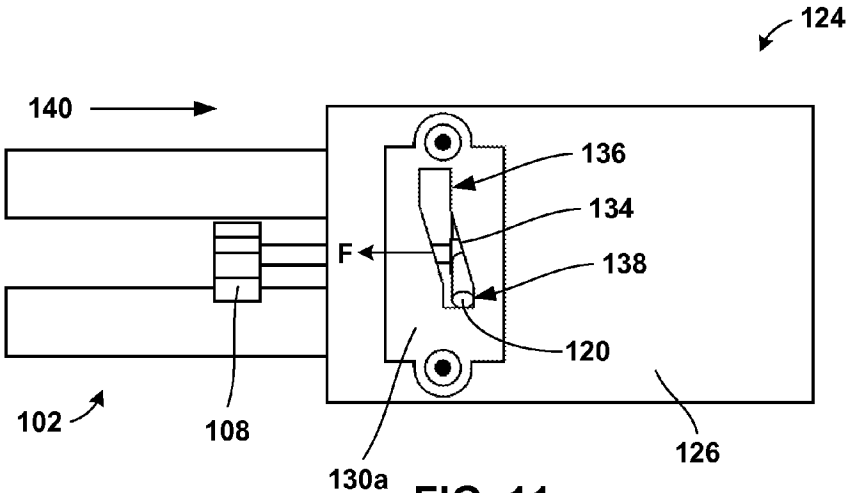
FIG. 11 depicts an orthographic projection of FIG. 10 according to one embodiment.
Figure 12:
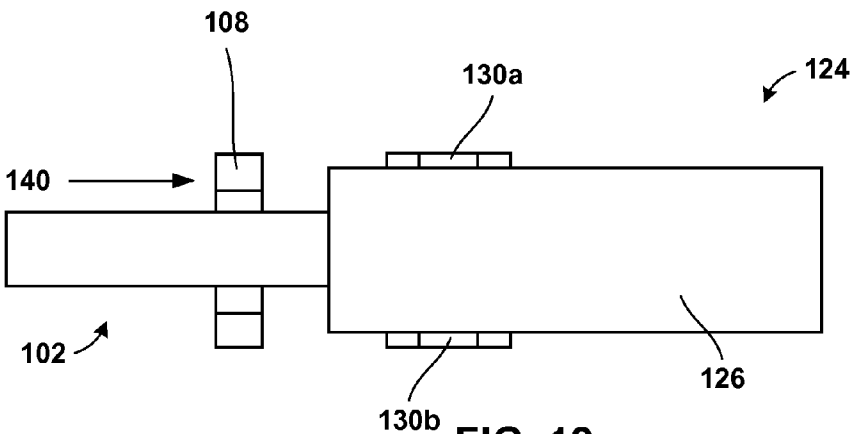
FIG. 12 depicts an orthographic projection of FIG. 10 according to one embodiment.

Now referring to FIGS. 10, 11, and 12, each of which depict a view of the connector 102 mating with the receptacle 124 according to one embodiment of the invention. The front end 111 (FIG. 1) of the connector 102 may be inserted into the opening 127 (FIG. 6) of the receptacle 124 (FIG. 6). Upon inserting the connector 102 into the receptacle 124, the plurality of pin contacts 114 (not shown) may mate with the plurality of socket contacts 128 (not shown). The cam 108 is shown in the lock position 138. The process of mating the connector 102 with the receptacle 124 may include inserting the connector 102 into the receptacle 124 followed by rotating the cam 108 clockwise approximately 90 degrees causing the actuator 120 to engage with the channel 134 of the pair of cam guides 130*a*, 130*b*. Assuming the receptacle 124 is fixed, the contact between the actuator 120 and the channel 134 may impose a linear force 140 perpendicular to the rotation of the cam 108. The linear force 140 will act on the connector 102 and continue to insert the connector 102 until it is fully seated in the receptacle 124. The linear force 140 may be the result of rotating the cam 108 and the interaction between the actuator 120 and the pair of cam guides 130*a*, 130*b*. Such an interaction may involve the actuator 120 applying a force F, against the pair of cam guides 103*a*, 130*b*. The linear force 140 may range from about 0 lbs to about 50 lbs. More preferably, the linear force may range from about 10 lbs to about 40 lbs.

Figure 13:
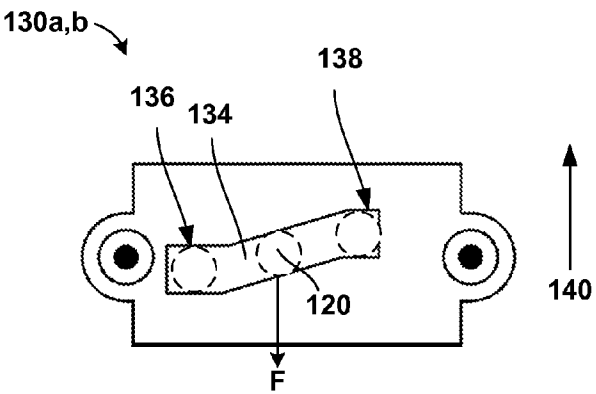
FIG. 13 depicts an orthographic projection of a cam guide and illustrates a path of a cam actuator relative to the cam guide according to one embodiment.

Now referring to FIG. 13, the actuator 120 of the cam 108 is illustrated at multiple positions relative to the cam guide 130*a*, 130*b* during a simulated rotation. Note the receptacle 124 and the connector 102 are omitted from FIG. 13 for illustrative purposes only. Again, the clockwise rotation of the cam 108 may cause the actuator 120 of the cam 108 to engage with the channel 134 of the pair of cam guides 130*a*, 130*b*. Initially, the actuator 120 may engage with the pair of cam guides 130*a*, 130*b* at the first portion 136 of the channel 134. The actuator 120 may follow the channel 134 during continued clockwise rotation of the cam 108. Finally, the actuator 120 may stop at the third portion 138 of the channel 134. During initial engagement of the actuator 120 at the first portion 136, little, if any, force may be exerted on the connector 102, assuming the receptacle 124 is fixed. As previously described, based on the rotational clockwise movement of the cam 108, the actuator 120 may travel/ride in the second portion 137 of the channel 134 thereby imposing a linear force 140 on the connector 102. The same clockwise rotation of the cam 108 may cause the actuator 120 to impose the force F against the pair of cam guides 130*a*, 130*b*. Finally, upon stopping at the third portion 138 of the channel 134, the actuator 120 may impose some nominal linear force to maintain the connection between the connector 102 and the receptacle 124.

It may be understood that clockwise or counter-clockwise rotation of the cam 108 should provide some mechanical advantage for inserting and removing the connector relative to the receptacle. This mechanical advantage may be based on the length of the cam handle 116 and the angle of the channel 134 in the cam guide 130.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A cable assembly structure, the structure comprising:

a connector including:

a connector body having a back end and a front end;

a cam comprising a handle and an actuator spaced apart from each other and each extending perpendicularly from a shaft, the shaft is rotatably coupled to and extends perpendicularly from the back end of the connector body, and the cam is rotatable about the shaft;

a wire bundle extending from and coupled to the back end of the connector body; and a pair of guidance features extending from the front end of the connector body; and a receptacle including:

a receptacle body having a fixed end and an open end; and a pair of cam guides positioned on a top and a bottom surface of the receptacle, the pair of cam guides each comprising an identical channel, the receptacle is configured to receive the connector body aligned by the guidance features such that when the cam of the connector body is rotated the actuator of the cam engages with and directly contacts each identical channel of the pair of cam guides to produce a linear force in a direction parallel to an axis of the shaft sufficient to draw the connector body together with the receptacle.

2. The structure of claim 1, wherein the axis of the shaft is substantially perpendicular to the back end of the connector body.

3. The structure of claim 1, wherein the wire bundle comprises a plurality of individually insulated wires.

4. The structure of claim 1, wherein the wire bundle comprises a compressive sheath.

5. The structure of claim 1, wherein the cam comprises a recess to accept a tool for rotating the cam.

6. The structure of claim 1, wherein each identical channel of the pair of cam guides comprises a first portion, a second portion, and a third portion, and wherein:

the first portion of each identical channel is oriented substantially parallel to an edge of the open end of the receptacle, the second portion having a first angle relative to the edge of the open end of the receptacle, and the third portion having a second angle relative to the edge of the open end of the receptacle.

7. The structure of claim 6, wherein the linear force is approximately 0 lbs when the actuator of the cam engages with and directly contacts the first portion of each identical channel of the pair of cam guides.

8. The structure of claim 6, wherein the linear force ranges from approximately 10 lbs to approximately 50 lbs when the actuator of the cam engages with and directly contacts the second portion of each identical channel of the pair of cam guides.

9. The structure of claim 6, wherein the linear force is sufficient to maintain a connection between the receptacle and the connector when the actuator of the cam engages with and directly contacts the third portion of each identical channel of the pair of cam guides.

10. The structure of claim 1, wherein the receptacle further comprises a plurality of socket contacts located at the fixed end.

11. A connector structure having a connector body, the connector body having a back end and a front end, the structure comprising:

a cam comprising a handle and an actuator spaced apart from each other and each extending perpendicularly from a shaft, the shaft is rotatably coupled to and extends perpendicularly from the back end of the connector body, and the cam is rotatable about the shaft;

a wire bundle extending from the back end of the connector body; and a pair of guidance features extending from the front end of the connector body, wherein the pair of guidance features align the connector structure with a receptacle structure, and the connector structure is received by the receptacle structure such that when the cam of the connector structure is rotated the actuator of the cam engages with and directly contacts a channel of each of an identical pair of cam guides of the receptacle structure to produce a linear force in a direction parallel to an axis of the shaft sufficient to draw the connector structure together with the receptacle structure.

12. The structure of claim 11, wherein the axis of the shaft is perpendicular to the back end of the connector body.

13. The structure of claim 11, wherein the wire bundle comprises a compressive sheath.

14. The structure of claim 11, wherein the cam comprises a recess to accept a tool for rotating the cam.

15. A receptacle structure comprising a receptacle body having a fixed end and an open end, the structure comprising:

a pair of cam guides positioned on a top and a bottom surface of the receptacle body, the pair of cam guides each comprising an identical channel, the receptacle structure is configured to receive a connector structure such that when a cam of the connector structure is rotated an actuator of the cam engages with and directly contacts each identical channel of the pair of cam guides to produce a linear force in a direction parallel to an axis of rotation of the cam sufficient to draw the connector structure together with the receptacle structure;

wherein the cam comprising a handle and an actuator spaced apart from each other and each extending perpendicularly from a shaft, the shaft is rotatably coupled to and extends perpendicularly from the back end of the connector body, and the cam is rotatable about the shaft.

16. The structure of claim 15, wherein each identical channel of the pair of cam guides comprise a first portion substantially parallel to an edge of the open end of the receptacle body, a second portion having a first angle relative to an edge of the open end of the receptacle body, and a third portion having a second angle relative to an edge of the open end of the receptacle body.

17. The structure of claim 16, wherein the linear force is approximately 0 lbs when the actuator of the cam engages with and directly contacts the first portion of each identical channel of the pair of cam guides.

18. The structure of claim 16, wherein the linear force ranges from approximately 10 lbs to approximately 50 lbs when the actuator of the cam engages with and directly contacts the second portion of each identical channel of the pair of cam guides.

19. The structure of claim 16, wherein the linear force is sufficient to maintain a connection between the receptacle and the connector when the actuator of the cam engages with and directly contacts the third portion of each identical channel of the pair of cam guides.

20. The structure of claim 15, wherein a plurality of receptacle bodies are aligned adjacent to one another, the cam guides of the plurality of receptacle bodies being substantially co-planar to one another, and the fixed ends of the plurality of receptacle bodies being substantially co-planar to one another.

* * * * *